US010089867B2

(12) United States Patent
Kashiwai et al.

(10) Patent No.: US 10,089,867 B2
(45) Date of Patent: Oct. 2, 2018

(54) ANOMALOUS TRAVEL LOCATION DETECTION DEVICE AND ANOMALOUS TRAVEL LOCATION DETECTION METHOD

(71) Applicant: TOYOTA JIDOSHA KABUSHIKI KAISHA, Toyota-shi, Aichi-ken (JP)

(72) Inventors: Tadahiro Kashiwai, Chofu (JP); Ryo Neyama, Tokyo (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 42 days.

(21) Appl. No.: 15/110,765

(22) PCT Filed: Dec. 22, 2014

(86) PCT No.: PCT/JP2014/083888
§ 371 (c)(1),
(2) Date: Jul. 11, 2016

(87) PCT Pub. No.: WO2015/111344
PCT Pub. Date: Jul. 30, 2015

(65) Prior Publication Data

US 2016/0379484 A1 Dec. 29, 2016

(30) Foreign Application Priority Data

Jan. 21, 2014 (JP) ..... 2014-008450

(51) Int. Cl.
*G08G 1/01* (2006.01)

(52) U.S. Cl.
CPC ..... *G08G 1/0129* (2013.01); *G08G 1/0112* (2013.01); *G08G 1/0141* (2013.01)

(58) Field of Classification Search
CPC ... G08G 1/0112; G08G 1/0129; G08G 1/0141
See application file for complete search history.

(56) References Cited

U.S. PATENT DOCUMENTS 5,850,193 A * 12/1998 Shimoura ..... G01C 21/26 340/439
2010/0318254 A1 12/2010 Yamamura et al.
(Continued)

FOREIGN PATENT DOCUMENTS

JP 2006-313519 A 11/2006
JP 2009-9495 A 1/2009
JP 2013-3913 A 1/2013

OTHER PUBLICATIONS

Setsuo Hirai et al. "Incident Detection by Probe Data", http://www.nilim.go.jp/japanese/its/3paper/pdf/061220wc_4.pdf, Dec. 20, 2006.

*Primary Examiner* — Quan-Zhen Wang
*Assistant Examiner* — Rajsheed Black-Childress
(74) *Attorney, Agent, or Firm* — Sughrue Mion, PLLC

(57) ABSTRACT

A turning value corrector corrects turning values contained in multiple pieces of travel history information. A reference turning value calculator uses multiple turning values that have been associated with the same calculation point to calculate a reference turning value. An anomalous travel location detector calculates the divergence from the reference turning value for each piece of travel history information subjected to detection of an anomalous travel location. Locations for which the deviation from the reference turning value is large are detected as anomalous travel locations.

8 Claims, 5 Drawing Sheets

(56) References Cited

U.S. PATENT DOCUMENTS

2012/0320210 A1 12/2012 Imai et al.
2015/0088335 A1* 3/2015 Lambert ..... G08G 1/162
701/1

* cited by examiner

ANOMALOUS TRAVEL LOCATION DETECTION DEVICE AND ANOMALOUS TRAVEL LOCATION DETECTION METHOD

CROSS REFERENCE TO RELATED APPLICATIONS

This application is a National Stage of International Application No. PCT/JP2014/083888 filed Dec. 22, 2014 claiming priority based on Japanese Patent Application No. 2014-008450, filed Jan. 21, 2014, the contents of which are incorporated herein by reference in their entirety.

TECHNICAL FIELD

The present disclosure relates to an anomalous travel location detection device and an anomalous travel location detection method for detecting a location where anomalous traveling in the road width direction occurs due to, for example, avoidance of an obstruction.

BACKGROUND ART

In recent developments in intelligent transport systems (ITS), detection of a location where anomalous traveling in the road width direction occurs (anomalous travel location) due to, for example, avoidance of an obstruction has been increasingly desired. Detecting such anomalous travel locations will offer users, for example, notification of anomalous travel locations or drive assistance in consideration of anomalous travel locations.

Conventional devices for detecting anomalous travel locations include a deviation identification device that identifies any deviation of the vehicle from the lane (see Patent Document 1, for example). The deviation identification device uses road image data taken by an on-board imaging device or the turning degree of the vehicle to determine whether the vehicle is likely to deviate from the lane.

PRIOR ART DOCUMENT

Patent Document

Patent Document 1: Japanese Laid-Open Patent Publication No. 2013-3913

SUMMARY OF THE INVENTION

Problems that the Invention is to Solve

However, the on-board imaging device used for the deviation identification device is of a low prevalence for reasons including its relatively high cost. Thus, when lane deviation information is collected from a plurality of vehicles with deviation identification devices to detect anomalous travel locations, the amount of collected data would not be sufficient to obtain information unaffected by individual variability and having higher generality. Development of a system that can obtain information about anomalous travel locations using a prevalent sensor has been desired.

It is an objective of the present disclosure to obtain information about anomalous travel locations on roads using a prevalent sensor.

Means for Solving the Problems

In accordance with one aspect of the present disclosure, an anomalous travel location detection device is provided that detects an anomalous travel location where anomalous traveling in a road width direction occurs. The anomalous travel location detection device includes a history information obtainer, a turning value corrector, a reference turning value calculator, and an anomalous travel location detector. The history information obtainer is configured to obtain from a vehicle a plurality of pieces of travel history information, each including a turning value that indicates a physical quantity related to a position of the vehicle and turning of the vehicle. The turning value corrector is configured to correct the turning values in the pieces of travel history information. The turning value corrector is configured to correct the turning values to turning values associated with preset calculation points. The reference turning value calculator is configured to calculate a reference turning value using the turning values that are associated with a common one of the calculation points. The reference turning value is an average turning value. The anomalous travel location detector is configured to calculate a divergence from the reference turning value for each piece of travel history information subjected to detection of an anomalous travel location. The anomalous travel location detector is configured to detect a location where the divergence from the reference turning value is large as the anomalous travel location.

In accordance with another aspect of the present disclosure, an anomalous travel location detection method is provided that detects an anomalous travel location where anomalous traveling in a road width direction occurs. The anomalous travel location detection method includes: obtaining from a vehicle a plurality of pieces of travel history information, each including a turning value that indicates a physical quantity related to a position of the vehicle and turning of the vehicle; correcting the turning values included in the pieces of travel history information to turning values associated with preset calculation points; calculating a reference turning value using the turning values that are associated with a common one of the calculation points, wherein the reference turning value is an average turning value; calculating a divergence from the reference turning value for each piece of travel history information subjected to detection of an anomalous travel location; and detecting a location where the divergence from the reference turning value is large as the anomalous travel location.

The configuration and method described above use a sensor that senses turning values and detect an anomalous travel location based on the divergence between the reference turning value, which is the average turning value of a plurality of turning values associated with each calculation point, and the turning value included in the travel history information subjected to detection. Thus, a prevalent sensor, such as a yaw rate sensor, can be used to obtain information about anomalous travel locations on roads.

In accordance with one form of the disclosure, the anomalous travel location detector is configured to calculate an absolute deviation of each of the turning values associated with the common one of the calculation points, and the anomalous travel location detector is further configured to calculate, for each piece of travel history information subjected to detection of an anomalous travel location, the divergence by dividing a difference between each of the turning values associated with the common one of the calculation points and the reference turning value by the absolute deviation.

The use of the absolute deviation in calculation of divergence in this configuration increases the robustness of divergences against outliers.

In accordance with one form of the disclosure, the anomalous travel location detector is configured to calculate a transition of the divergence of each turning value from the reference turning value along the calculation points, and the anomalous travel location detector is further configured to smooth the calculated transition of the divergence.

The smoothing of the transition of divergences in this configuration limits effects of turning value outliers, which may be caused by deflection in steering operation, on the detection of anomalous travel locations.

In accordance with one form of the disclosure, the anomalous travel location detector is configured to detect an anomalous travel location for each piece of travel history information subjected to detection of an anomalous travel location, and the anomalous travel location detector is further configured to, when a frequency of anomalous travel locations is high at a common location in a plurality of pieces of travel history information in which anomalous travel locations have been detected, conclusively determine the common location to be the anomalous travel location.

In this configuration, among the anomalous travel locations from pieces of travel history information, the anomalous travel location of a high frequency is conclusively determined as an anomalous travel location. This allows for obtainment of information not limited to a specific individual.

In accordance with one form of the disclosure, the turning value in the travel history information is a yaw rate of the vehicle.

In this configuration, yaw rates, which enable identification of travel paths in the road width direction in cooperation with information such as vehicle speed, are used as variables for determining anomalous travel locations. This increases the accuracy of detected anomalous travel locations. When the travel history information is collected from a plurality of vehicles, the vehicle simply sends travel history information including yaw rates, and the anomalous travel location detection device simply performs statistical processing of yaw rates of a plurality of vehicles. When the travel history information subjected to statistical processing is collected based on the travel history of one vehicle, the vehicle simply obtains the travel history information including yaw rates. Compared to a configuration that detects an anomalous travel location using image data taken by an on-board imaging device, for example, the configuration described above reduces the costs and computation loads on the on-board control unit and the anomalous travel location detection device.

MODES FOR CARRYING OUT THE INVENTION

An anomalous travel location detection device and an anomalous travel location detection method according to one embodiment will now be described. In this embodiment, the anomalous travel location detection device is a device that is a part of a probe car system. The probe car system collects probe information, which is travel history information generated by a plurality of cars.

Figure 1:
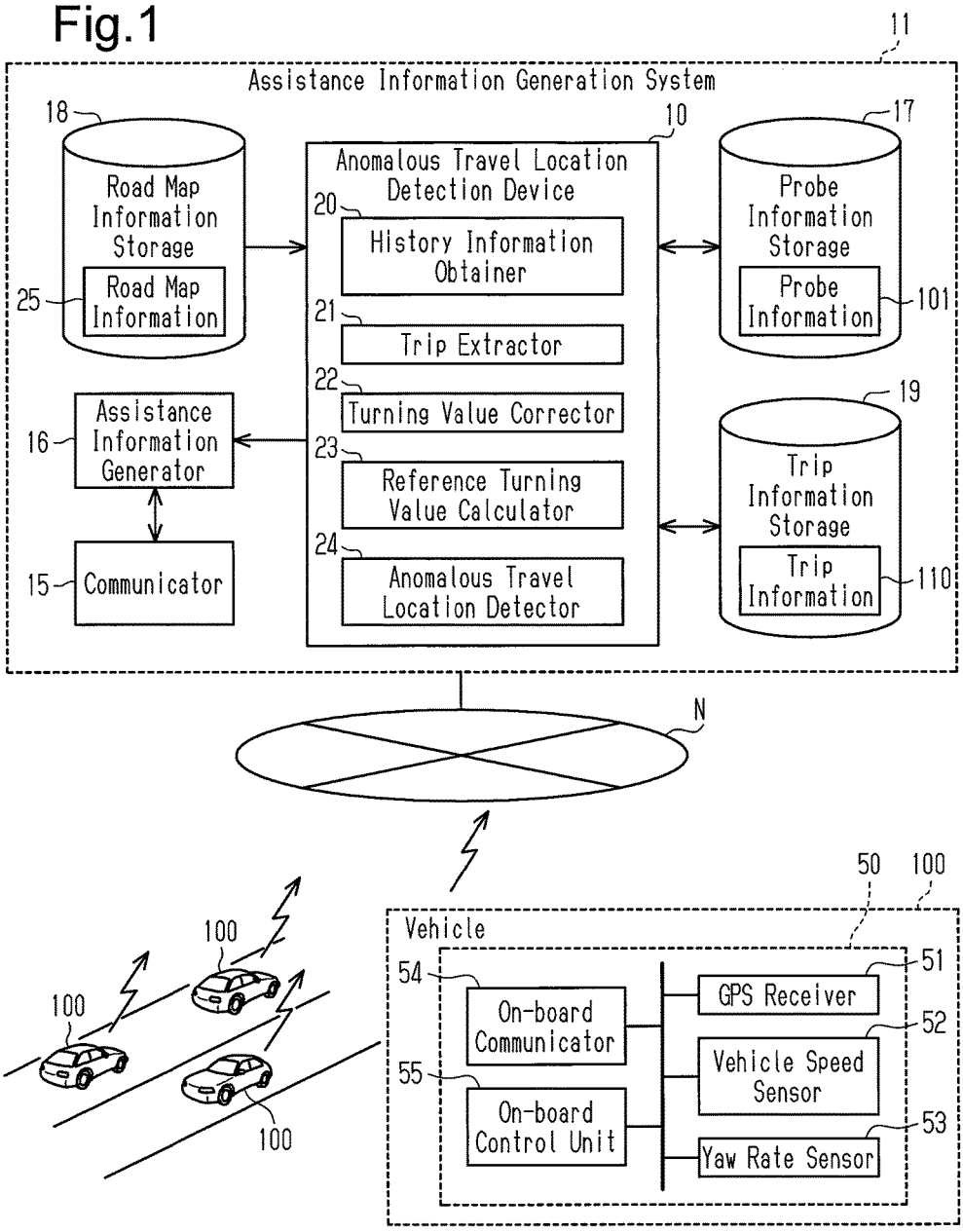
FIG. 1 is a block diagram schematically showing the configuration of an assistance information generation system including an anomalous travel location detection device according to the present disclosure.

As shown in FIG. 1, an anomalous travel location detection device (hereinafter referred to as a detection device 10) of the present embodiment, which detects a location where anomalous traveling of a vehicle in the road width direction occurs, is a part of an assistance information generation system 11, which generates assistance information used to offer road information and driving assistance, for example. The assistance information generation system 11 is connected via a network N to a probe transmission system 50 installed in a vehicle 100.

The probe transmission system 50 installed in the vehicle 100 will now be described. The probe transmission system 50 may include a GPS receiver 51, which receives radio waves sent from global positioning system (GPS) satellites, a vehicle speed sensor 52, a yaw rate sensor 53, an on-board communicator 54, and an on-board control unit 55. The on-board control unit 55 calculates the latitude and longitude of the vehicle position as the absolute position coordinates based on the radio wave detection signal received through the GPS receiver 51. The on-board control unit 55 receives wheel speed pulses from the vehicle speed sensor 52 and receives the yaw rate, which is the angular velocity in the turning direction of the vehicle 100, from the yaw rate sensor 53. The on-board control unit 55 generates probe information 101, which is travel history information, and sends the generated probe information 101 to the assistance information generation system 11 via the on-board communicator 54.

Figure 2:
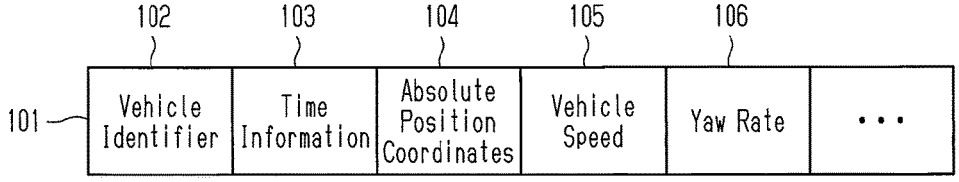
FIG. 2 is a diagram showing the data structure of probe information sent from vehicles shown in FIG. 1.

As shown in FIG. 2, the probe information 101 may include a vehicle identifier 102, time information 103, absolute position coordinates 104, a vehicle speed 105, and a yaw rate 106. The vehicle identifier 102 allows the assistance information generation system 11 to identify the vehicle 100 that has sent the information. The time information 103 indicates the date and time when the probe information 101 is generated. The absolute position coordinates 104 are calculated based on the GPS radio wave signals. The vehicle speed 105 is based on the vehicle wheel speed pulses that are received by the on-board control unit 55 from the vehicle speed sensor 52. The yaw rate 106 is received from the yaw rate sensor 53.

Referring to FIG. 1, the assistance information generation system 11 will now be described. In addition to the detection device 10, the assistance information generation system 11 may include a communicator 15, which receives probe information 101, and an assistance information generator 16. The assistance information generation system 11 may also include a probe information storage 17, a road map information storage 18, and a trip information storage 19.

In the present embodiment, the detection device 10, which may include hardware such as CPU, RAM and ROM and a program for detecting anomalous travel locations, functions as a history information obtainer 20, a trip extractor 21, a turning value corrector 22, a reference turning value calculator 23, and an anomalous travel location detector 24.

The history information obtainer 20 obtains probe information 101 sent from the vehicle 100 through the communicator 15 and stores the obtained probe information 101 in the probe information storage 17.

From the stored probe information 101, the trip extractor 21 reads the pieces of probe information 101 that are generated under a common condition. For example, the trip extractor 21 reads the pieces of probe information 101 that are generated in a certain travel region on an expressway or highway, or reads the pieces of probe information 101 that are generated in a certain travel region during certain time of day. In the present embodiment, when reading pieces of probe information 101 of the same travel region, the information pieces obtained in different lanes in the same travel region are handled as the information pieces of the same travel region. From the probe information 101 that is read, the trip extractor 21 extracts necessary data from the pieces of probe information 101 that are sent continuously from one vehicle 100 and handles these pieces of probe information 101 as trip information 110, in which pieces of probe information 101 are arranged in chronological order of transmission. The "trip" is a unit in which a vehicle travels from a starting point (departure point) to an endpoint (destination) for a certain purpose. The trip extractor 21 stores the generated trip information 110 in the trip information storage 19.

The road map information storage 18 stores road map information 25. The road map information 25 may include links, which are sections delimited by intersections, traffic signals, junctions, or the like and nodes, which are located on opposite ends of links.

The assistance information generator 16 generates road information and information for driving assistance based on the information sent from the detection device 10. The communicator 15 sends the generated information to the vehicle 100 through the network N.

Referring to FIGS. 3 to 9, the operation of the detection device 10 will now be described.

Figure 3:
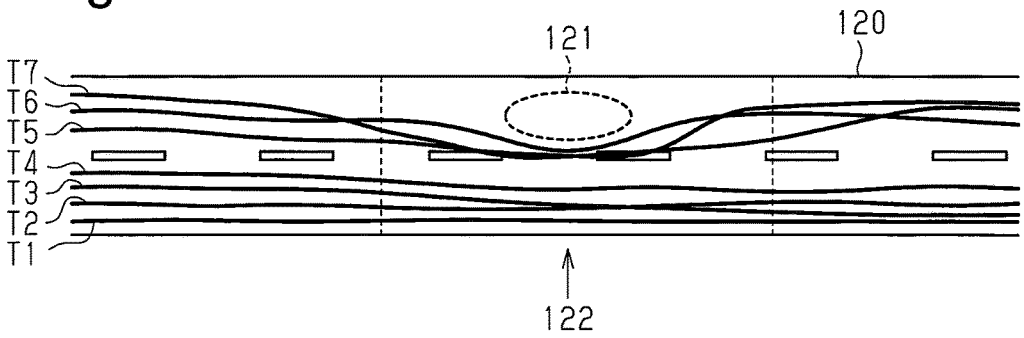
FIG. 3 is a schematic view showing an example of travel paths of the trips shown in FIG. 1.

First, an anomalous travel location will be described referring to FIG. 3. When there are vehicle travel paths associated with trips Tj the number of which is represented by "nt" ($1 \leq j \leq nt$), all of the travel paths may extend along the road in some sections depending on the driving environment. However, when there is an avoidance location 121, such as a parked vehicle or a disabled vehicle, or when one lane is congested, the vehicle travel paths vary in the road width direction as shown in a section 122, which is one of the sections divided in the length direction of the road 120, in FIG. 3. When there is a trip Tj that diverges significantly from the travel path along the road and when there is a plurality of trips Tj that diverges significantly in the same section, such a section is detected as an anomalous travel location. The anomalous travel location may also be detected as a point instead of a section having a length in the travel direction of road as shown in FIG. 3.

Figure 4:
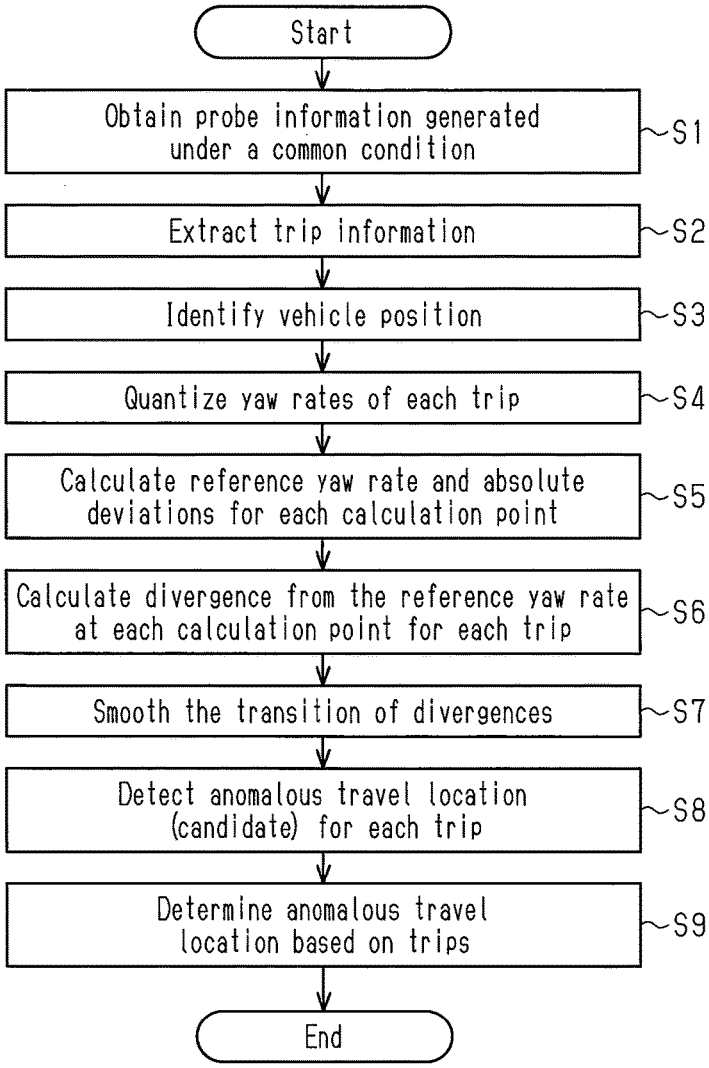
FIG. 4 is a flowchart showing the operation of the anomalous travel location detection device of FIG. 1.

Referring to FIG. 4, the main steps for detecting an anomalous travel location will now be described. The detection device 10 obtains the probe information 101 that is generated under a common condition (step S1) and extracts trip information 110 from the probe information 101 (step S2). Based on the trip information 110, the detection device 10 identifies the vehicle position for each trip Tj to increase the accuracy of the vehicle position (step S3).

Since the measurement positions of yaw rates in the trip information 110 vary, the detection device 10 quantizes the yaw rates by establishing association between the yaw rates and calculation points xi, which are set at regular intervals (step S4). Using the quantized yaw rates, the detection device 10 calculates a reference yaw rate, which is the average of the yaw rates at a calculation point xi and serves as a reference turning value, and yaw rate absolute deviations (step S5).

The detection device 10 then individually reads each piece of trip information 110 that has been used to calculate the average value and absolute deviations and uses the trip information 110 to detect an anomalous travel position. The detection device 10 first calculates, for each piece of trip information 110, the divergence of the quantized yaw rate from the reference yaw rate (step S6). The divergence is calculated at each calculation point xi. The detection device 10 smooths the transition of divergences at the calculation points xi to exclude outliers caused by deflection in steering operation, for example (step S7). The detection device 10 determines whether the curve indicating the transition of the smoothed divergences includes a region that is greater than or equal to a predetermined threshold and detects such a region as an anomalous travel location of the trip (step S8). In this stage, the anomalous travel location detected for each trip is considered as a potential anomalous travel location.

The detection device 10 integrates the anomalous travel locations calculated for the trips and conclusively detects an anomalous travel location (step S9).

Figure 5:
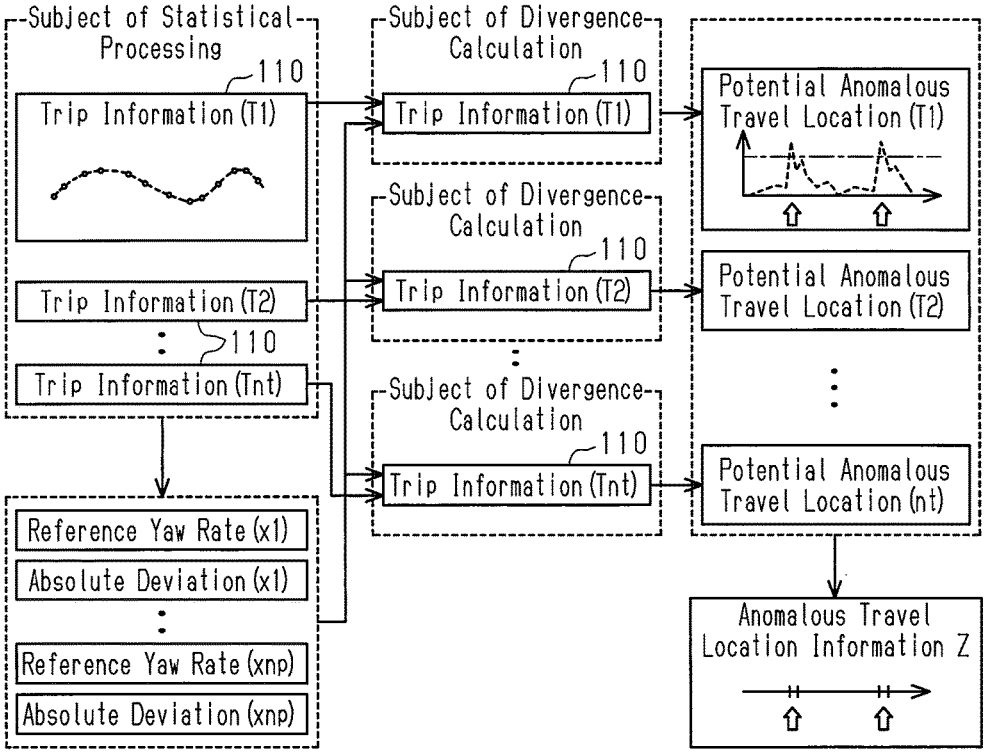
FIG. 5 is an explanatory diagram showing the flow of data used by the anomalous travel location detection device of FIG. 1 to detect an anomalous travel location.

Referring to FIG. 5, the flow of data in the operation described above will now be described. To calculate reference yaw rates and absolute deviations, a plurality of pieces of trip information 110 are used as subjects of statistical processing. Then, using the reference yaw rates and the absolute deviations, the divergences from the reference yaw rates are calculated separately for each piece of trip information 110. In the present embodiment, each piece of trip information 110 used as a subject of statistical processing is read separately to calculate divergences. After calculating divergences for each piece of trip information 110, potential anomalous travel locations are detected for each piece of trip information 110 based on the calculated divergences. The pieces of trip information 110 in which a potential anomalous travel location is detected are used to conclusively determine an anomalous travel location based on the frequency of anomalous travel locations in the same location, for example.

Each of the steps will now be described in detail. In step S1, the detection device 10 obtains, from the probe information 101 stored in the probe information storage 17, pieces of probe information 101 that are identical in the travel direction of the vehicle 100 and generated under a common condition, such as a predetermined travel region or predetermined travel region and time of day, as described above.

In step S2, of the obtained probe information 101, the detection device 10 extracts necessary data from the pieces of probe information 101 that are continuously sent from one vehicle 100 and generates trip information 110, which is a sequence of data arranged in chronological order.

In step S3, the detection device 10 identifies the position of the vehicle 100 that has sent the probe information 101 based on the absolute position coordinates 104, the time information 103 and the vehicle speed 105 included in the trip information 110. In the present embodiment, the detection device 10 checks for an error in the absolute position coordinates 104. When identifying a major error, the detection device 10 interpolates vehicle positions between the absolute position coordinates with the vehicle speed integral which is obtained by integrating the vehicle speed 105 with respect to time. This technique increases the accuracy of the vehicle position when the reception of GPS radio waves is poor and multipath propagation occurs, for example.

Quantization of Yaw Rates

Figure 6:
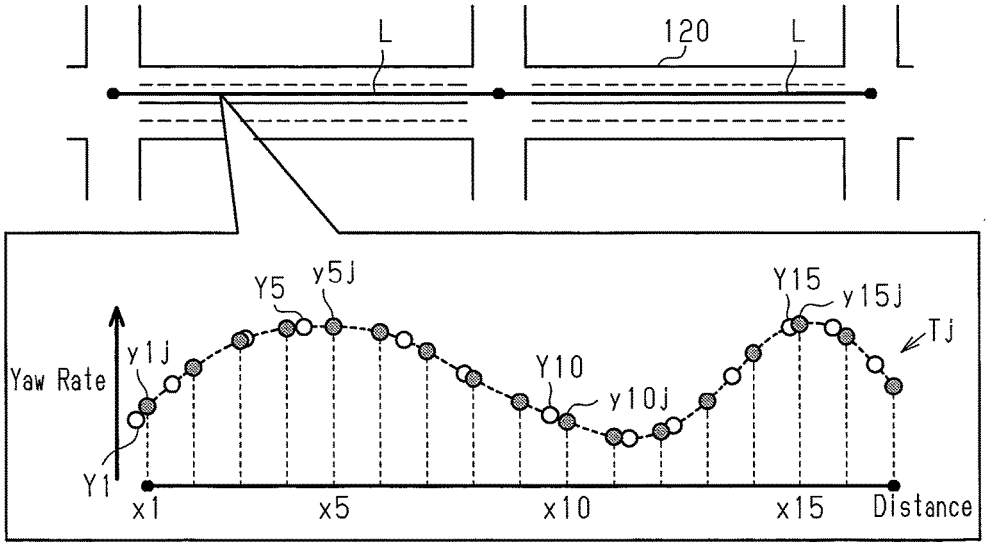
FIG. 6 is an explanatory diagram showing how yaw rates in the trip shown in FIG. 2 are quantized.

Referring to FIG. 6, step S4, which quantizes the yaw rates 106, will now be described. The detection device 10 first reads the link information of the travel region to be calculated from the road map information 25 stored in the road map information storage 18 and sets calculation points xi ($1 \le i \le np$) on one link L at regular intervals of 0.1 m, for example. The calculation points xi may be preset in association with the link L.

The detection device 10 reads one piece of trip information 110 and obtains from the trip information 110 a plurality of yaw rates Y1, Y2 . . . measured on the link and the vehicle positions indicating the positions where the yaw rates are obtained. The vehicle positions are the positions identified in step S3. The detection device 10 compares the calculation points xi with the vehicle positions where the yaw rates are detected. If these positions coincide, the detection device 10 does not correct the yaw rates. If these positions do not coincide, the detection device 10 performs interpolation between the actually measured yaw rates using a known method such as linear interpolation or interpolation using a spline curve. The detection device 10 then calculates the yaw rates yij that are associated with the calculation points xi based on the interpolated values. The suffix "i" indicates the identification number of calculation point, and the suffix "j" indicates the identification number of trip. The number of calculation points xi is indicated by "np", and the number of trips Tj is indicated by "nj".

After calculating the yaw rates yij associated with the calculation points xi for one trip Tj, the detection device 10 calculates yaw rates yij for another trip Tj.

Calculation of Reference Yaw Rates and Absolute Deviations

Figure 7:
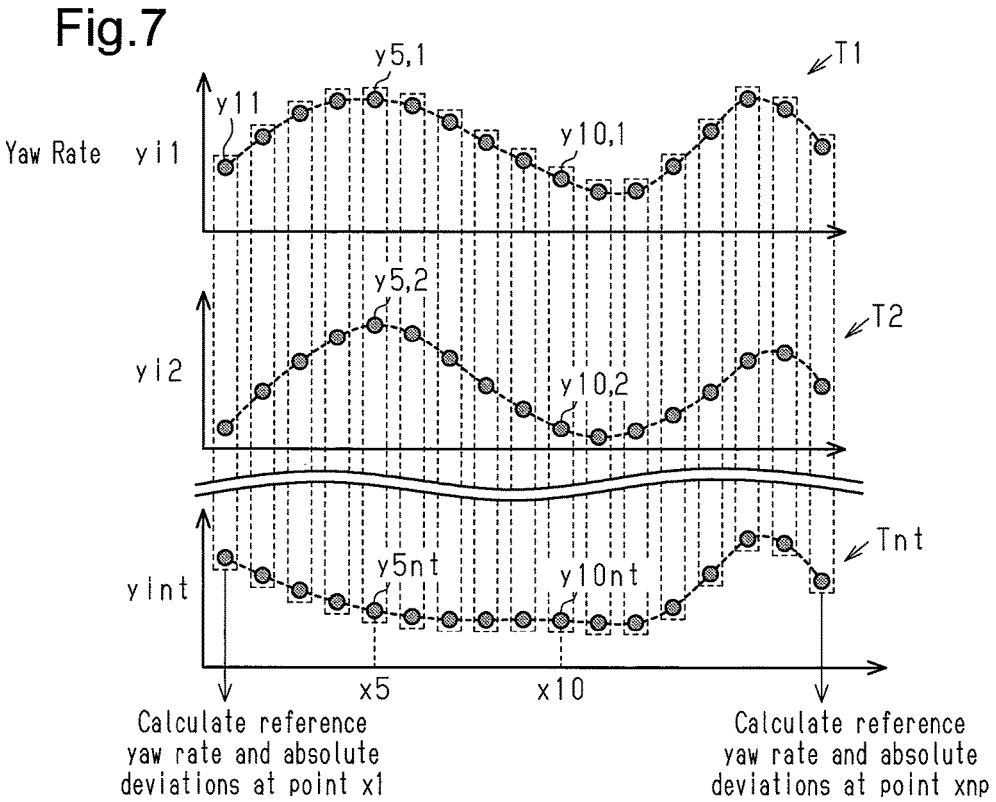
FIG. 7 is an explanatory diagram showing how the average reference value and absolute deviations of the yaw rates shown in FIG. 6 are obtained.

Referring to FIG. 7, step S5, which calculates reference yaw rates and absolute deviations, will now be described. For example, the detection device 10 obtains yaw rates y1*j*, which are y11, y12, . . . , y1*np*, of the trips Tj, which are T1, T2, . . . , Tnt, associated with the calculation point x1 and calculates the median value median(y1*j*) as a reference yaw rate. The detection device 10 repeats this process for the calculation points x2, . . . , xnp to calculate median values median(yij), which are median(y2*j*), median(y3*j*), . . . , median(ynpj).

The present embodiment calculates the median absolute deviation (MAD) using median values and Equation (1) below. That is, the detection device 10 calculates the median value of the differences between the yaw rates y11, y12, . . . , y1*np* at the calculation point x1 and the median value median(x1) to obtain the median value of the dispersion. The detection device 10 repeats this process for the calculation points x2, . . . , xnp to obtain MAD(x2), . . . , MAD(xnp). The obtainment of the median values increases the robustness against outliers.

Equation (1)

$$MAD = 1.4826 \cdot \text{median}(|yij - \text{median}(yij)|) \quad (1)$$

Calculation of Divergences

The calculation of divergences in step S6 will now be described. As described above, step S6 processes a single piece of trip information 110. Using Equation (2) below, the detection device 10 subtracts the median value median(yij) at a certain calculation point xi from the yaw rate yij at the calculation point xi and divides the subtraction result by the median absolute deviation MAD(yij) to obtain a divergence ŷij. Divergences ŷij are obtained for each calculation point xi in one trip Tj. After calculating the divergences ŷij for one trip Tj, the divergence ŷij at each calculation point xi in another trip Tj is obtained.

Equation (2)

$$\hat{y}ij = \frac{yij - \text{median}(yij)}{MAD(yij)} \quad (2)$$

Smoothing of Divergences

The smoothing of divergences in step S7 will now be described. The divergences ŷij at a calculation point xi include outliers caused by deflection in steering operation, for example. Thus, the detection device 10 removes the outliers by smoothing the transition curve of divergences. Based on the vehicle speed 105 included in the trip information 110, the present embodiment sets a section from start to stop in each trip Tj in a predetermined travel region and calculates the moving average in the section. Here, the detection device 10 may calculate the moving average of the divergences ŷij for each fixed distance or for each fixed time period. The smoothing of divergences is performed for all trips Tj.

Detection of Potential Anomalous Travel Locations

Figure 8:
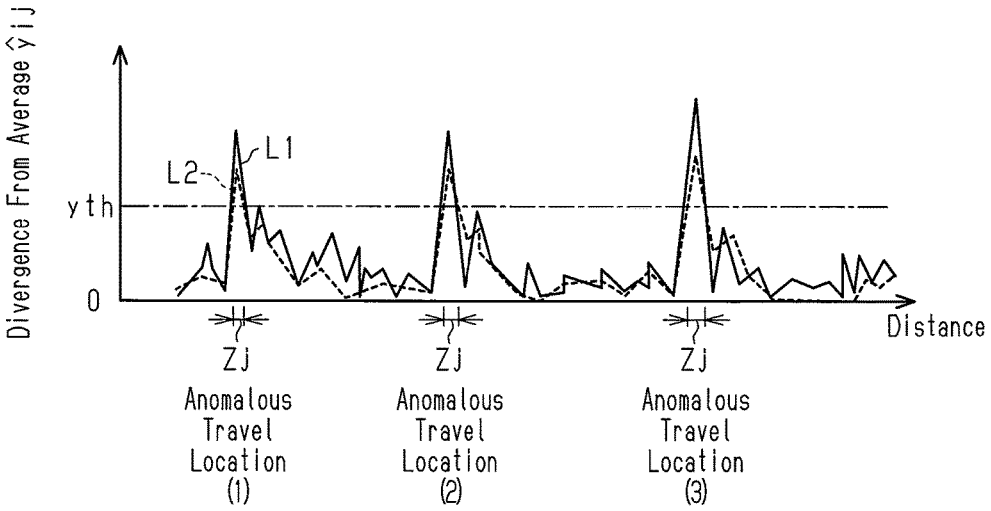
FIG. 8 is an explanatory diagram showing anomalous travel locations detected for a single piece of trip information shown in FIG. 8.

Referring to FIG. 8, detection of potential anomalous travel locations in step S8 will now be described. The detection device 10 determines whether the smoothed divergences include a region that exceeds a predetermined threshold yth. The threshold yth is set through tests so as to achieve a suitable balance between the precision and recall in detection of anomalous travel locations. The region where the divergence ŷij exceeds the threshold yth is detected as an anomalous travel location Zj of the trip Tj. The anomalous travel location Zj of each trip Tj is considered as a potential location used to conclusively determine an anomalous travel location Z. Detection of an anomalous travel location Zj is performed on each trip Tj.

Determination of Anomalous Travel Location

Figure 9:
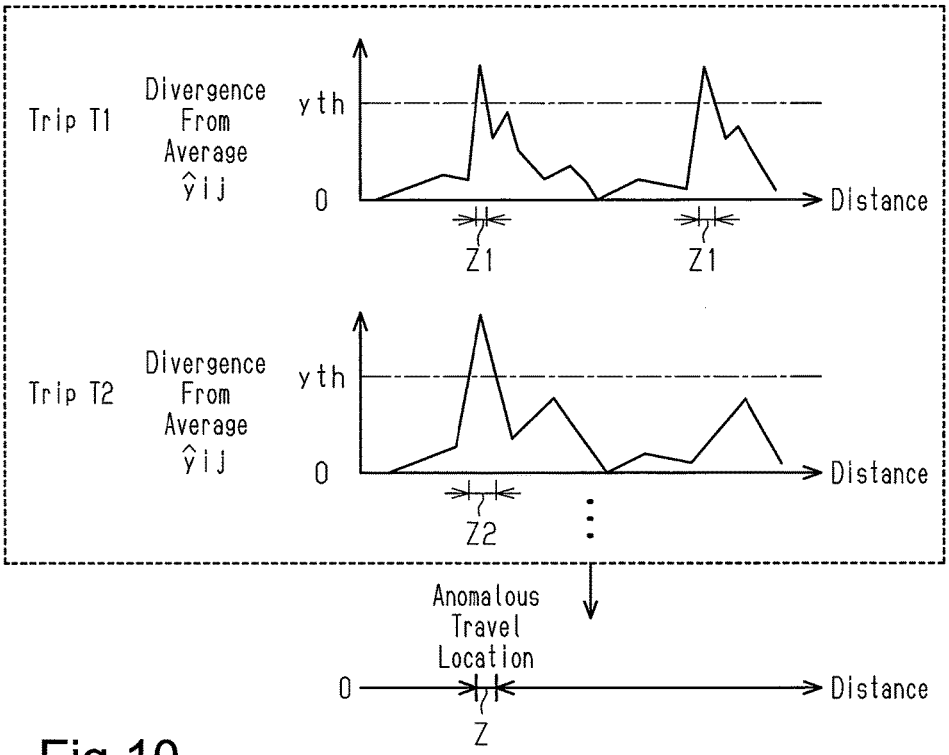
FIG. 9 is an explanatory diagram showing how an anomalous travel location is conclusively determined for the trip information shown in FIG. 8.

Referring to FIG. 9, determination of anomalous travel location in step S9 will now be described. Since the anomalous travel locations Zj detected in trips Tj (T1, T2, . . . ) do not necessarily coincide or overlap one another, a position or section in which the frequency of anomalous travel locations Zj is relatively high is determined to be an anomalous travel location Z.

Even if a potential anomalous travel location of a trip Tj overlaps with a potential anomalous travel location of another trip Tj, these anomalous travel locations are not necessarily of the same length. Thus, the length of the anomalous travel location Z is determined based on the distance between the anomalous travel locations Zj of different trips Tj or overlapping regions between anomalous travel locations Zj. For example, only the position or section where anomalous travel locations Zj overlap one another may be determined as an anomalous travel location Z. If anomalous travel locations Zj of a plurality of trips Tj are close to one another, the section including all of the anomalous travel locations Zj that are close to one another may be determined as an anomalous travel location Z.

After detecting an anomalous travel location, the detection device 10 sends the information about the anomalous travel location to the assistance information generator 16. Based on the information about the anomalous travel location, the assistance information generator 16 generates and sends road information and driving assistance information to the vehicles 100 via the communicator 15 and the network N.

The operation of detecting an anomalous travel location through the method described above will now be described.

For example, when one of many vehicles traveling along the road changes lanes, the section of lane change in the trip of this vehicle will be detected as an anomalous travel location. However, this section will not be detected as an anomalous travel location in other trips. Accordingly, step S9 does not determine this section to be an anomalous travel location Z.

In contrast, when a vehicle is parked on a driving lane of a road, for example, some of the vehicles traveling on the driving lane may depart from the lane 50 m before the parked vehicle, and others may depart the lane 10 m before the parked vehicle. The travel paths of the vehicles driving on the lane differ from one another accordingly, increasing the dispersion of the yaw rates yij at a calculation point xi near the parked vehicle. In this case, although the median absolute deviation MAD(yij) at the calculation point xi may increase, many yaw rates yij may diverge significantly from the median value median(yij). Thus, as long as the distances between the calculation points xi and distances for smoothing are set appropriately, the number of trips Tj in which the yaw rates yij exceed the threshold at the calculation point xi near the parked vehicle increases. The point or section with the parked vehicle can thus be detected as an anomalous travel location. Points or sections that can be detected as anomalous travel locations are not limited to locations where a vehicle is parked, and may be a location where a disabled vehicle, an accident vehicle or a dropped object on the road is present, a location where a certain lane is congested, or a location before an intersection.

The present embodiment thus provides the following advantages.

(1) The median value of yaw rates is obtained from a plurality of yaw rates yij associated with each calculation point xi. When detecting an anomalous travel location from the trip information 110 subjected to detection of anomalous travel locations, a location where the divergence ŷij of the yaw rate yij associated with a calculation point xi from the median yaw rate at the calculation point xi is large is detected as an anomalous travel location. This allows information about anomalous travel locations on roads to be obtained using prevalent sensors that are typically installed in vehicles. Thus, the information about anomalous travel locations is not affected by individual variability or sporadic factors, thereby increasing the generality of information.

(2) When calculating yaw rates yij associated with a calculation point xi and the divergences ŷij of the yaw rates yij associated with the calculation point xi from the median value, the median absolute deviation MAD(yij), which is based on a plurality of yaw rates yij associated with the calculation point xi, is used. The divergence ŷij between the median value and the yaw rate yij for detection can be calculated based on the average divergence from the median value at the calculation point xi. This enhances the robustness of divergence ŷij against outliers.

(3) The moving average is calculated for the transition of divergences ŷij along calculation points xi. This reduces effects of outliers of turning value, which may be caused by deflection in steering operation, on the detection of anomalous travel locations.

(4) To conclusively determine whether a location is an anomalous travel location Z, a plurality of pieces of trip information 110 in which anomalous travel locations Zj are detected is used so that a location with higher frequency is concluded to be an anomalous travel location Z. This allows for obtainment of information not limited to a specific individual.

(5) Yaw rates yij, which enable identification of travel paths in the road width direction in cooperation with information such as vehicle speed, are used as variables for determining anomalous travel locations Z. This increases the accuracy of detected anomalous travel locations Z and Zj. The vehicle 100 simply sends probe information 101 including yaw rates 106, and the anomalous travel location detection device 10 simply performs statistical processing on yaw rates of a plurality of vehicles. Compared to a configuration that detects an anomalous travel location using image data taken by an on-board imaging device, for example, the present embodiment, which uses a prevalent sensor, reduces costs of vehicles and loads, including computation loads on the on-board control unit 55 and the anomalous travel location detection device 10. In addition, there is no need to prepare image data analysis applications for devices such as the on-board control unit 55.

Other Embodiments

The above illustrated embodiment may be modified as follows.

The anomalous travel location detection device 10 of the above embodiment includes CPU, RAM, ROM and the like. However, other configuration may be used, and the detection device may include an application-specific integrated circuit (ASIC), for example.

The above embodiment includes the trip information storage 19 in addition to the probe information storage 17. However, as long as trip information 110 can be temporarily stored in a storage, the trip information storage may be omitted.

Instead of the vehicle identifier 102, the probe information 101 may include a user identifier assigned to each driver. The probe information 101 may include the travel direction. This eliminates the need for the anomalous travel location detection device 10 to identify the travel direction of the vehicle 100. The probe information 101 may include information on the driving lane of the vehicle 100. This allows the anomalous travel location detection device 10 to easily determine for each driving lane whether anomalous traveling in the lane width direction has occurred.

In the embodiment described above, an anomalous travel location is a section defined by dividing a road in the road length direction. However, when the vehicle positions are detected with high accuracy, a position in the road width direction may be identified.

In the embodiment described above, the detection device 10 performs extraction of trips. Instead, the detection device 10 may obtain trip information 110 generated by other device or by vehicles.

The embodiment described above calculates the divergences of yaw rates using the median yaw rate and median absolute deviation. However, the factor "1.4826" in Equation (1) may be omitted. An average other than the median value may be used, and an absolute deviation other than the median absolute deviation may be used. For example, the arithmetic average value and average absolute deviation of a plurality of yaw rates associated with a calculation point may be used to calculate the divergences of yaw rates. The arithmetic average value is (yi1+yi2+ . . . +yin)/n when yaw rates yij the number of which is represented by "n" are used. To obtain the average absolute deviation, all of the absolute values |yij−Avr|, each obtained by subtracting the yaw rate arithmetic average value Avr from the yaw rate yij, of yaw rates the number of which is represented by "n" are added to obtain a total sum. The average absolute deviation may be obtained by dividing the total sum |yi1−Avr|+|yi2−Avr|+ . . . +|yin−Avr| by "n" or may be obtained by further multiplying the divided value by the factor of "1.253."

The above embodiment conclusively determines an anomalous travel location by integrating the anomalous travel location of each trip. However, depending on the purpose of assistance information, all anomalous travel locations of the trips may be determined as an anomalous travel location.

The vehicle position may be identified by methods other than interpolation of absolute position coordinates with the vehicle speed integral. For example, the vehicle position may be identified using the absolute position coordinates and the road map information 25. Alternatively, the vehicle position may be identified using the vehicle speed integral and the road map information 25. Further, the detection device 10 does not have to perform the identification of vehicle position. The identification of vehicle position may be performed on the vehicle side, and the anomalous travel location detection device 10 may use the identified vehicle position.

The above embodiment sets the calculation points xi at regular intervals. However, the calculation points xi may be set at irregular intervals. For example, the density of calculation points may be increased near intersections and reduced in other regions.

The above embodiment smooths the transition of divergences by a moving average. However, outliers may be removed by other known smoothing processes such as a low-pass filter.

Figure 10:
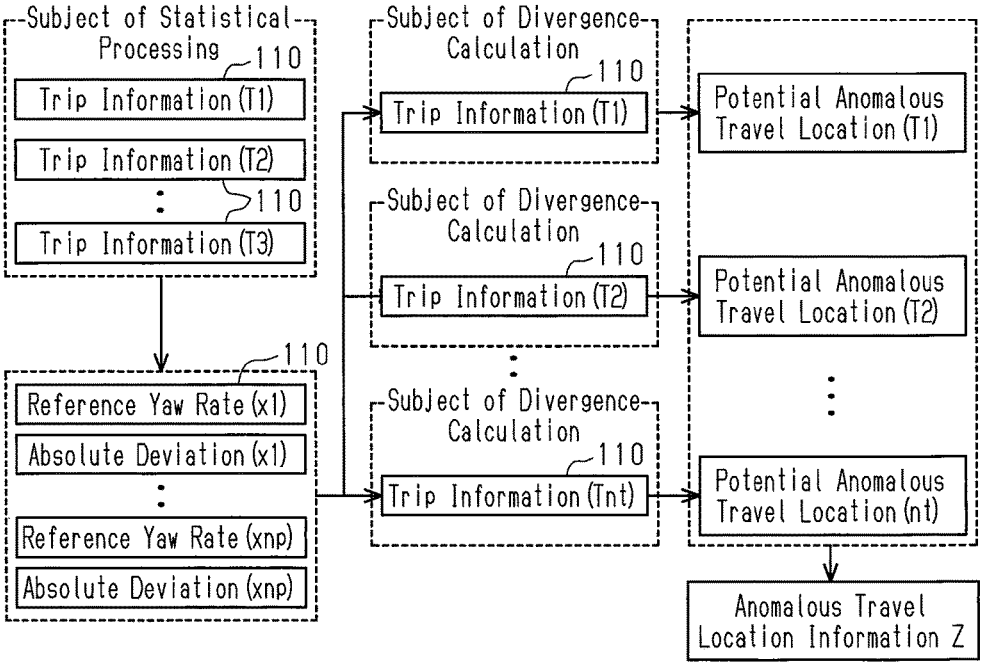
FIG. 10 is an explanatory diagram showing the flow of data used by a modification of anomalous travel location detection device to detect an anomalous travel location.

As shown in FIG. 10, depending on the purpose of anomalous travel location detection, the trips (T1, T2, . . . , Tnt) used as subjects of statistical processing to calculate the reference yaw rate may be set separately from the trips (TA1, TA2, . . . , TAn) used as subjects of divergence calculation. In this embodiment, the time period in which the trip information 110 used as subject of statistical processing is collected may be longer than the time period in which the trip information 110 used as subject of divergence calculation is collected. This increases the generality of information obtained from the trip information 110 used as subject of statistical processing. Comparison between the trip information 110 for statistical processing and the trip information 110 for divergence calculation allows for detection of anomalous traveling while removing outliers caused by deflection in steering operation, for example. This increases the generality of anomalous travel location information.

The embodiment described above smooths the transition of divergences. However, such smoothing may be omitted, and the divergences may be compared with a threshold. This embodiment may be set such that a part of the transition of divergences that is detected to reach or exceed the threshold will not be detected as an anomalous travel location if this part is shorter than a predetermined length.

The above embodiment calculates divergences using Equation (2). That is, the absolute value of difference between the yaw rate associated with a calculation point and the median value of a plurality of yaw rates associated with the calculation point is divided by the median absolute deviation of the plurality of yaw rates associated with the calculation point. However, the method for calculating divergences may be modified depending on the application of anomalous travel location information, and divergences may be calculated by other methods. For example, when obtaining divergences including outliers, such divergences may simply be the differences between the yaw rates associated with a calculation point and the reference yaw rate such as an arithmetic average or median.

In addition to the yaw rate 106, the probe information 101 may include as turning values the lateral acceleration, steering angle, or relative direction measured by a gyroscope. The probe information 101 may include two or more of the yaw rate 106, lateral acceleration, steering angle, and relative direction measured by a gyroscope. Further, the probe information 101 may include information indicating the on/off state of direction indicators and at least one of the yaw rate 106, lateral acceleration, steering angle, and relative direction measured by a gyroscope. This allows for detection of the turning direction intended by the user. The detection device 10 detects the behavior of the vehicle 100 in the road width direction based on the turning values in the probe information 101.

The anomalous travel location detection device 10 of the above embodiment is a part of an assistance information generation system, which generates road information and drive assistance information. However, the detection device 10 may be used as a device that simply detects anomalous travel locations by collecting and providing statistics about probe information 101. In this case, the information on anomalous travel locations may be used for traffic study, for example.

The above embodiment obtains turning values from the yaw rate sensor installed in the vehicle. However, turning values may be obtained through means other than on-board sensors, such as a gyroscope installed in a handheld terminal that is brought into the vehicle, such as a smartphone or tablet, or a sensor that can detect the vehicle direction, such as a rotation vector sensor.

The anomalous travel location detection device 10 of the above embodiment is a part of a probe car system. However, the anomalous travel location detection device 10 may be installed in the vehicle 100. In this case, the anomalous travel location detection device 10 collects and stores the travel history information of the vehicle 100 and performs statistical processing on pieces of travel history information that are collected at different times to calculate the reference yaw rate and absolute deviations in a predetermined travel region. A piece of travel history information used as a subject of statistical processing or the latest travel history information may be used as a subject of divergence calculation to calculate the divergence from the reference yaw rate. An anomalous travel location is determined based on the divergence. When an anomalous travel location is detected in this embodiment, the driver may receive a warning when driving through the anomalous travel location for the next time. Alternatively, the driver may receive a warning when the anomalous travel location is detected.

DESCRIPTION OF THE REFERENCE NUMERALS

10: anomalous travel location detection device, 11: assistance system, 15: communicator, 16: assistance information generator, 17: probe information storage, 18: road map information storage, 19: trip information storage, 20: history information obtainer, 21: trip extractor, 22: turning value corrector, 23: reference turning value calculator, 24: anomalous travel location detector, 50: history transmission system, 51: GPS receiver, 52: vehicle speed sensor, 53: yaw rate sensor, 54: on-board communicator, 54: on-board control unit, 100: vehicle, 101: probe information, 101: trip information, N: network

The invention claimed is:

1. An anomalous travel location detection device for detecting an anomalous travel location where anomalous traveling in a road width direction occurs, the anomalous travel location detection device comprising:

a history information obtainer configured to obtain from a vehicle a plurality of pieces of travel history information, wherein each piece includes a position value and a turning value at the position value;

a turning value estimator configured to estimate turning values at preset calculation positions, wherein the turning value estimator estimates the turning values at the preset calculation positions if the preset calculation positions are different from the position values in the travel history information;

a reference turning value calculator configured to calculate a reference turning value using the turning values that are associated with a common preset calculation position, wherein the reference turning value is an average turning value; and an anomalous travel location detector configured to calculate a divergence of each turning value from the reference turning value for each piece of travel history information subjected to detection of an anomalous travel location, wherein the anomalous travel location detector is configured to detect a location where the divergence from the reference turning value is greater than or equal to a predetermined threshold as the anomalous travel location.

2. The anomalous travel location detection device according to claim 1, wherein:

the anomalous travel location detector is configured to calculate an absolute deviation of the turning values associated with the common preset calculation position, and the anomalous travel location detector is further configured to calculate, for each piece of travel history information subjected to detection of an anomalous travel location, the divergence by dividing a difference between each of the turning values associated with the common preset calculation position and the reference turning value by the absolute deviation.

3. The anomalous travel location detection device according to claim 1, wherein:

the anomalous travel location detector is configured to calculate a transition of the divergence of each turning value from the reference turning value along the preset calculation positions, and the anomalous travel location detector is further configured to smooth the calculated transition of the divergence.

4. The anomalous travel location detection device according to claim 1, wherein:

the anomalous travel location detector is configured to detect an anomalous travel location for each piece of travel history information subjected to detection of an anomalous travel location, and the anomalous travel location detector is further configured to detect that a frequency of anomalous travel locations is high at a common location in the plurality of pieces of travel history information, and conclusively determine the common location to be the anomalous travel location.

5. The anomalous travel location detection device according to claim 1, wherein the turning value in the travel history information is a yaw rate of the vehicle.

6. The anomalous travel location detection device according to claim 1, wherein the turning value estimator estimates a turning value at a preset calculation position by interpolating between turning values in the travel history information that are adjacent to the preset calculation position.

7. An anomalous travel location detection method for detecting an anomalous travel location where anomalous traveling in a road width direction occurs, the anomalous travel location detection method comprising:

by using a history information obtainer, obtaining from a vehicle a plurality of pieces of travel history information, wherein each piece includes a position value and a turning value at the position value;

by using a turning value estimator, estimating the turning values at preset calculation positions that are different from the position values in the travel history information;

by using a reference turning value calculator, calculating a reference turning value using the turning values that are associated with a common preset calculation position, wherein the reference turning value is an average turning value;

by using an anomalous travel location detector, calculating a divergence of each turning value from the reference turning value for each piece of travel history information subjected to detection of an anomalous travel location; and by using the anomalous travel location detector, detecting a location where the divergence from the reference turning value is greater than or equal to a predetermined threshold as the anomalous travel location.

8. The anomalous travel location detection method according to claim 7, wherein estimating a turning value at a preset calculation position comprises interpolating between turning values in the travel history information that are adjacent to the preset calculation position.

* * * * *